US008324544B2

(12) United States Patent
Palani et al.

(10) Patent No.: US 8,324,544 B2
(45) Date of Patent: Dec. 4, 2012

(54) MULTI-STAGE FIN DEPLOYMENT ASSEMBLY

(75) Inventors: Kumaraguru Poonamalli Palani, Valencia, CA (US); Raymond Lee Burt, Camarillo, CA (US)

(73) Assignee: Woodward HRT, Inc., Santa Clarita, CA (US)

( * ) Notice: Subject to any disclaimer, the term of this patent is extended or adjusted under 35 U.S.C. 154(b) by 281 days.

(21) Appl. No.: 12/792,159

(22) Filed: Jun. 2, 2010

(65) Prior Publication Data

US 2012/0175460 A1 Jul. 12, 2012

(51) Int. Cl.
*F42B 15/01* (2006.01)

(52) U.S. Cl. ..... 244/3.24; 244/3.27

(58) Field of Classification Search ..... 244/3.24, 244/3.27, 3.28, 3.29, 49
See application file for complete search history.

(56) References Cited

U.S. PATENT DOCUMENTS

| | | | | |
|---|---|---|---|---|
| 4,143,838 | A | 3/1979 | Holladay | |
| 4,296,895 | A | 10/1981 | Pazmany | |
| 4,404,714 | A | 9/1983 | Duran | |
| 4,795,110 | A | 1/1989 | Lang | |
| 5,007,762 | A | 4/1991 | Duran | |
| 5,379,969 | A * | 1/1995 | Marx et al. | 244/49 |
| 5,607,250 | A | 3/1997 | Tatterson et al. | |
| 6,152,645 | A | 11/2000 | Sanford | |
| 6,186,443 | B1 | 2/2001 | Shaffer | |
| 6,206,432 | B1 | 3/2001 | Kamiyama | |
| 6,224,013 | B1 * | 5/2001 | Chisolm | 244/3.27 |
| 6,299,101 | B1 | 10/2001 | Schroppel et al. | |
| 6,928,931 | B1 | 8/2005 | Biserød | |
| 6,948,685 | B2 | 9/2005 | Hawthorne | |
| 7,125,058 | B2 | 10/2006 | Hawthorne | |
| 7,316,370 | B2 | 1/2008 | Sankovic et al. | |
| 7,377,567 | B2 * | 5/2008 | Walsh | 294/82.28 |
| 2006/0278754 | A1 | 12/2006 | Sankovic et al. | |
| 2010/0050712 | A1 * | 3/2010 | Tong et al. | 70/185 |

FOREIGN PATENT DOCUMENTS

| | | | |
|---|---|---|---|
| DE | 2418915 | A1 | 10/1975 |
| EP | 0441669 | A | 8/1991 |
| EP | 1191271 | A | 3/2002 |

* cited by examiner

*Primary Examiner* — Timothy D Collins
*Assistant Examiner* — Jamie S Stehle
(74) *Attorney, Agent, or Firm* — BainwoodHuang

(57) ABSTRACT

A multi-stage fin deployment assembly includes a rotary actuator configured to release a first spring-loaded stage that, when deployed, releases a second spring-loaded stage to deploy a set of deployable member or fins. By chaining these spring-loaded stages together, a relatively small input force, as provided by the rotary actuator, causes the second spring-loaded stage to generate a relatively large output force on the fins. This multistage force magnification makes it possible for the deployment assembly to utilize smaller actuators that require less power and take up less space, compared to conventional locking mechanisms.

23 Claims, 5 Drawing Sheets

MULTI-STAGE FIN DEPLOYMENT ASSEMBLY

BACKGROUND OF THE INVENTION

In general, conventional guided munitions have movable fins which control the flight paths of the guided munitions toward their targets. In some situations, such as prior to launch or during transportation, a locking mechanism holds or locks the fins rigidly in place, relative to the guided munitions. Such locking reduces wear, overstressing, and the possibility of damage to the steering systems within the guided munitions while the guided munitions are transported from location to location or carried by an aircraft for possible deployment. Additionally, the locking mechanism allows for rapid release, or unlocking, and deployment of the fins at the time of launching of the guided munitions.

Conventional locking mechanisms can be transitioned from a locked state to an unlocked state in a variety of ways. For example, one type of locking mechanism includes an explosive squib as part of the locking mechanism. The explosive squib can include a small tube that contains an explosive substance and a detonator disposed along a length of its core. Initially, the explosive squib holds or locks a spring-release mechanism against the fins of the guided munitions to maintain the fins in a retracted or non-deployed position. When the detonator receives an electric discharge signal, the detonator detonates the explosive squib to release the spring-release mechanism. With such a release, the spring-release mechanism causes the fins to move from the non-deployed position to a deployed position.

Another type of locking mechanism includes a ball locking mechanism as part of the locking mechanism. For example, the ball locking mechanism includes a housing, a cam, and a set of locking balls disposed between the cam and the housing. A rotary actuator is configured to rotate the cam from a first position that maintains the set of balls in a locked state relative to the housing and the cam to a second position to release the set of balls to an unlocked state relative to the housing and the cam. As the balls move from the locked state to the unlocked state, the locking mechanism moves from a locked position that retains fins of guided munitions in a non-deployed position to a released position. In the released position, the locking mechanism allows a release spring, having a relatively large spring force, to expand thereby causing the fins to move from a non-deployed or retracted position to a deployed position.

SUMMARY

The above-referenced conventional locking mechanisms that include an explosive squib suffer from a variety of deficiencies. For example, explosive forces generated by the explosive squib during detonation are not reliably consistent. For example, a conventional detonating squib can generate between about five pounds and fifteen pounds of force. With such variation, deployment systems that use locking mechanisms having explosive squibs must be designed to handle the full range of forces that the squib could potentially generate on detonation. Accordingly, for a conventional detonating squib, a deployment system must be designed to both deploy the fins of the guided munitions when the explosive squib generates the minimal five pounds of force during detonation and absorb forces that can interfere with the deployment of the fins when the explosive squib generates a maximal fifteen pounds of force during detonation Another deficiency to the above-described conventional locking mechanisms that include an explosive squib relates to the potential for interference with a guidance system. Conventional guided munitions typically include an onboard guidance system. If the guided munitions are missiles, for example, then the missiles may include onboard circuitry that either directly guides or receives remote instructions for the navigation of the missiles. A shock wave generated by a detonating squib can cause electrical errors in the circuitry of the onboard guidance system which, in turn, can cause the missile to miss its target.

As indicated above, with respect to the conventional ball locking mechanism, the rotary actuator is configured to rotate a cam from a first position that maintains a set of balls in a locked state relative to the housing and the cam to a second position to release the set of balls to an unlocked state relative to the housing and the cam. However, when the rotary actuator attempts to rotate from the first position to the second position, it must overcome the frictional force generated by the release spring as the spring pushes on the housing toward the rotary actuator. For example, the release spring applies relatively large forces, such as on the order of several hundred pounds, to cause the fins to move from a non-deployed, or retracted, position to a deployed position. Accordingly, the rotary actuator needs to be powerful enough to overcome the frictional force, thereby requiring the use of a relatively large rotary actuator to provide such power.

By contrast to the conventional locking mechanisms, embodiments of the invention relate to a multi-stage fin deployment assembly. In one arrangement, the deployment assembly includes a rotary actuator configured to release a first spring-loaded stage that, when deployed, releases a second spring-loaded stage to deploy a set of deployable member or fins. By chaining these spring-loaded stages together in series, a relatively small input force, as provided by the rotary actuator, causes the second spring-loaded stage to generate a relatively large output force on the fins. This multistage force magnification makes it possible for the deployment assembly to utilize smaller actuators that require less power and take up less space, compared to conventional locking mechanisms. Additionally, the chaining of spring-loaded stages provides a relatively consistent force output to the deployment assembly as compared to the wide range of force outputs that an explosive squib can produce. Such a relatively consistent force output minimizes the need for installation of additional shock absorbers within the deployment assembly to absorb the relatively excessive amount of force, as produced by explosive squibs.

In one arrangement, a deployment assembly is configured to deploy a set of deployable members relative to a support structure. The deployment assembly includes an actuator supported by the support structure, the actuator being constructed and arranged to provide an actuator force. The deployment assembly includes a first spring-loaded stage supported by the support structure and in operative communication with the actuator, the first spring-loaded stage being constructed and arranged to provide a first spring-loaded output force to a deployable member restraining element in response to the actuator force from the actuator to move the deployable member restraining element from a locked position to an unlocked position relative to the set of deployable members. The deployment assembly includes a second spring-loaded stage supported by the support structure and in operative communication with the first spring-loaded stage, the second spring-loaded stage being constructed and arranged to provide a second spring-loaded output force in response to the first spring-loaded output force from the first spring-loaded stage.

The second spring-loaded output force is applied to the set of deployable members to move the set of deployable members from an initial non-deployed configuration relative to the support structure to a subsequent deployed configuration relative to the support structure.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Embodiments of the invention relate to a multi-stage fin deployment assembly. In one arrangement, the deployment assembly includes a rotary actuator configured to release a first spring-loaded stage that, when deployed, releases a second spring-loaded stage to deploy a set of deployable member or fins. By chaining these spring-loaded stages together in series, a relatively small input force, as provided by the rotary actuator, causes the second spring-loaded stage to generate a relatively large output force on the fins. This multistage force magnification makes it possible for the deployment assembly to utilize smaller actuators that require less power and take up less space, compared to conventional locking mechanisms. Additionally, the chaining of spring-loaded stages provides a relatively consistent force output to the deployment assembly as compared to the wide range of force outputs that an explosive squib can produce. Such a relatively consistent force output minimizes the need for installation of additional shock absorbers within the deployment assembly to absorb the relatively excessive amount of force, as produced by explosive squibs.

Figure 1:
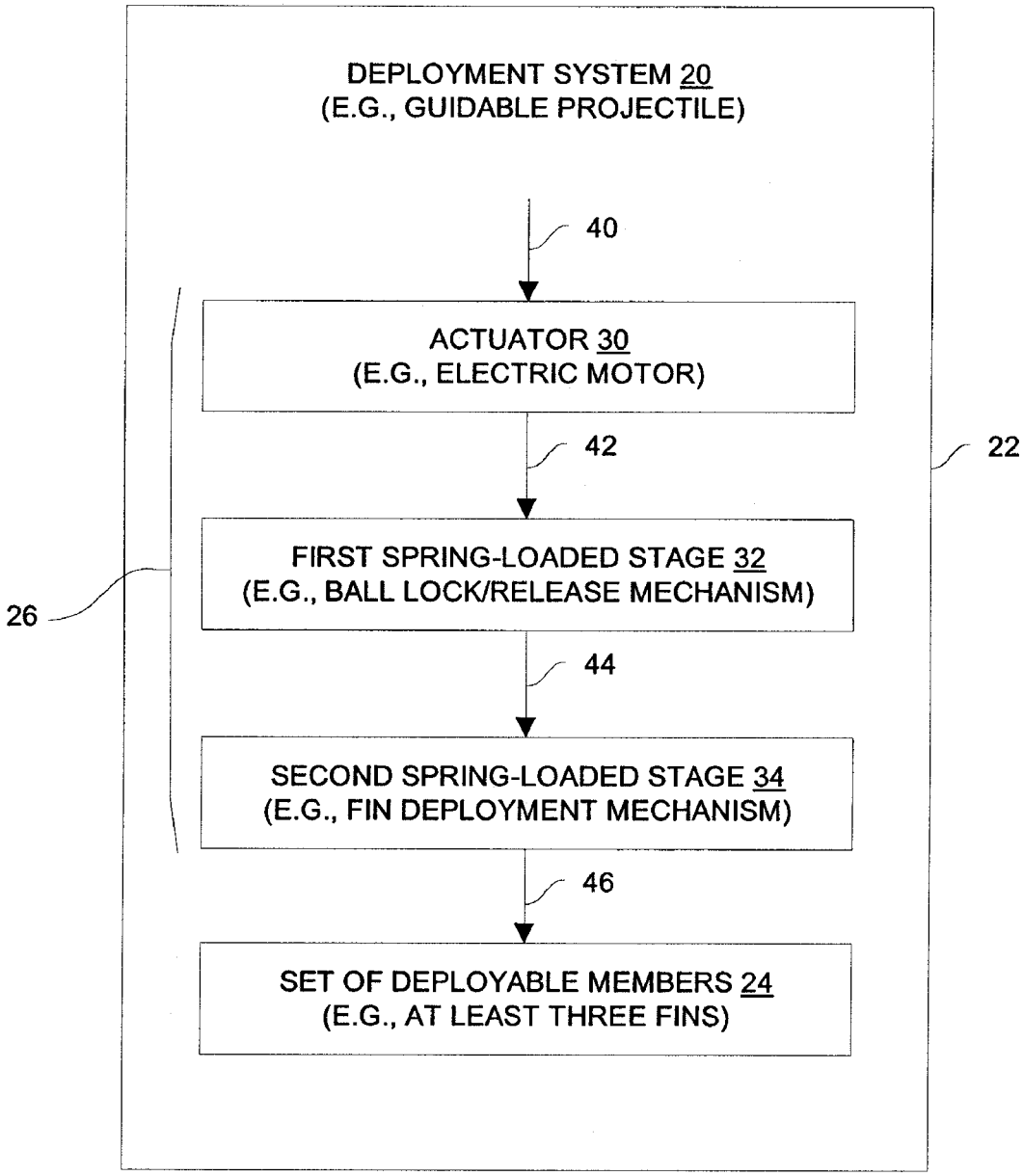
FIG. 1 is a block diagram of a deployment assembly that utilizes multi-stage force magnification, according to one embodiment.

FIG. 1 shows a block diagram of a deployment system 20, such as a guidable projectile, which utilizes multi-stage force magnification to provide relatively large force output in response to a relatively smaller force input. The deployment system 20 includes a support structure 22 (shown in FIG. 2), a set of deployable members 24, and a deployment assembly 26. The support structure 22, such as guidable projectile frame, provides robust and reliable support to the set of deployable members 24 and the deployment assembly 26. The deployment assembly 26 controls deployment of the set of deployable members 24 relative to the support structure 22.

The deployment assembly 26 includes an actuator 30, a first spring-loaded stage 32, and a second spring-loaded stage 34. Each of the components 30, 32, 34 of the deployment assembly 26 receives structural support from the support structure 22.

The actuator 30 is constructed and arranged to receive an electronic input, such as a control signal 40, and to provide an actuator force 42 to the first spring-loaded stage 32 in response to the electronic input 40. In some arrangements, the actuator 30 includes an electric motor, such as a brushless DC motor, or solenoid having a rotor which rotates about an axis of rotation, relative to a stator, in response to the electronic input 40.

The first spring-loaded stage 32 is constructed and arranged to receive the actuator force 42 from the actuator 30 and provide a first spring-loaded output force 44 in response to the actuator force 42. In some arrangements, as described below, the first spring-loaded stage 32 includes a ball lock/release mechanism which unlocks in response to the actuator force 42.

The second spring-loaded stage 34 provides a second spring-loaded output force 46 in response to the first spring-loaded output force 44 from the first spring-loaded stage 32. The second spring-loaded output force 46 is applied to the set of deployable members 24 to move the set of deployable members 24 from an initial non-deployed configuration relative to the support structure to a subsequent deployed configuration relative to the support structure.

It should be understood that the components of the deployment assembly 26 are constructed and arranged to operate in a cascading manner to achieve a multi-stage force magnification effect. Along these lines, the actuator 30 is capable of providing a relatively small actuator force 42 (e.g., torque) in response to the electronic input 40. In turn, the first spring-loaded stage 32 outputs a larger linear output force 44 to the second spring-loaded stage 34 due to release of a compressed spring in response to the small actuator force 42. Similarly, the second spring-loaded stage 34 in turn outputs an even larger linear output force 46 to the set of deployable members 24 due to release of a stronger compressed spring in response to the output force 44. Although the actuator 30 may be of limited size and thus provide a relatively small torque output, the cascading operation of the various components of the deployment assembly 26 ultimately results a relatively large force from the second spring-loaded stage 34 for successful deployment of the deployable members 24.

It should be understood that the deployment assembly 26 is suitable for a variety of applications. For example, in the context of a guidable projectile, the deployment assembly 26 is well-suited for robustly and reliably deploying multiple fins in a simultaneous manner from a guidable projectile frame. Further details will now be provided in connection with such an application and with reference to FIG. 2 and FIG. 3

Figure 2:
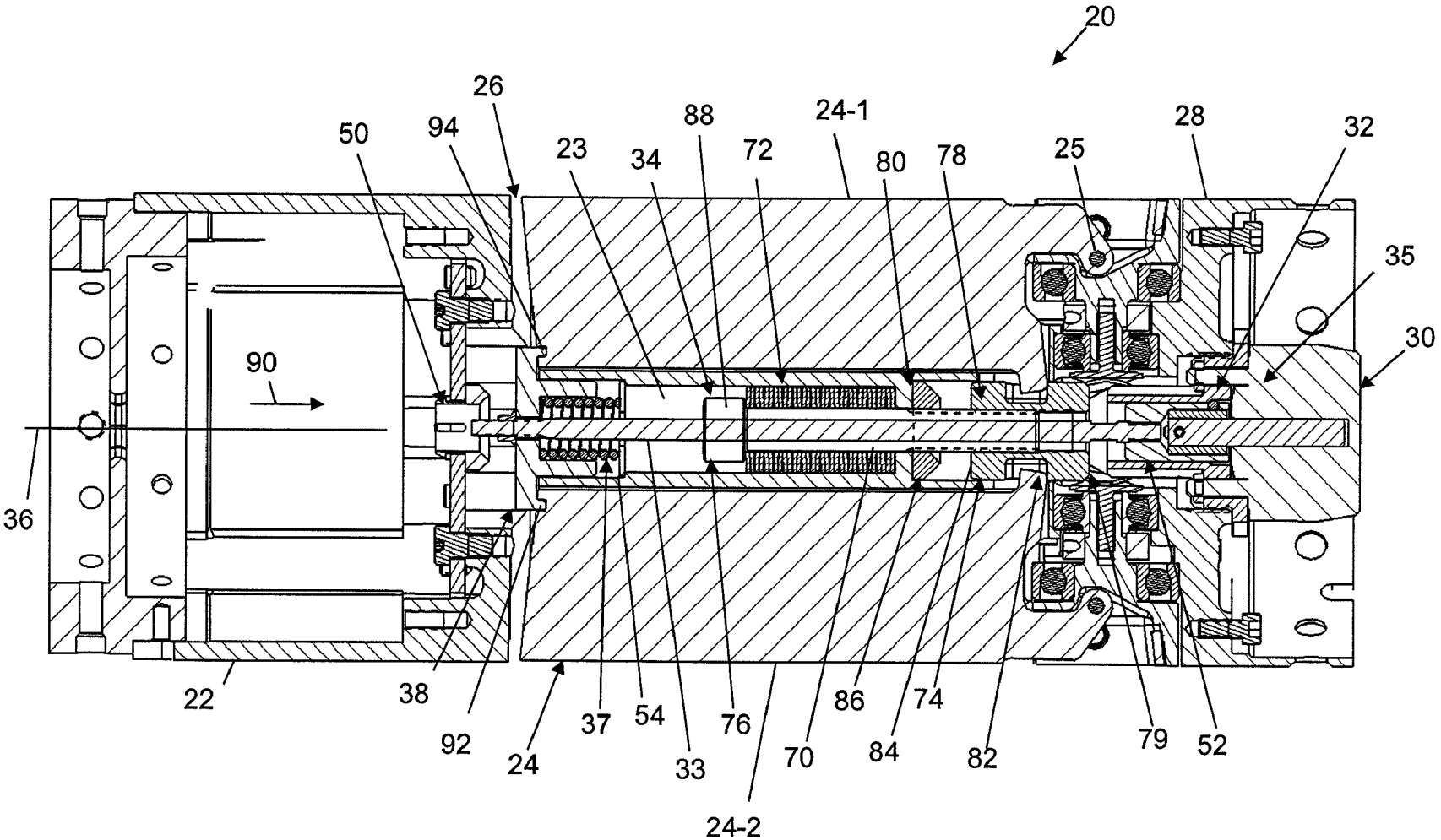
FIG. 2 illustrates a sectional view of an embodiment of the deployment assembly of FIG. 1, according to one embodiment.

FIG. 2 is a sectional view of an embodiment of the deployment system 20, such as a guidable projectile. The deployment system 20 includes a support structure 22, such as the guidable projectile frame, which carries the elements of the deployment assembly 26 as well as the deployable members 24. While the support structure 22 can carry the deployment assembly 26 in a variety of ways, in one arrangement, the support structure 22 defines a hollow core 23 to contain and protect the elements of the first spring-loaded stage 32 and the second spring-loaded stage 34.

FIG. 2 illustrates details of the elements of the deployable members 24, as well as the deployment assembly 26 of the deployment system 20 as will be described below.

In the arrangement illustrated, the deployable members 24 are configured as a set of fins that provide a level of guidance and control to the deployment system 20 when launched. FIG.

2 illustrates deployment system 20 as having two fins 24-1, 24-2. It should be understood that the set of fins 24 includes at least two fins to provide guidance to the deployment system 20 in use. While the support structure 22 can carry the set of fins in a variety of ways, in one arrangement, the support structure 22 secures each of the fins 24 to the deployment system 20 via a pivot mechanism 25, such as a shaft. In use, activation of the deployment assembly 26 along a common axis 36 of the deployment system 20 pivots each fin 24 about the pivot mechanism 25 in a radially outward direction relative to the common axis 36.

As further illustrated in FIG. 2, the first spring-loaded stage 32 of the deployment assembly 26 is configured to provide a first spring-loaded output force to a fin restraining element 38 in response to the actuator force from the actuator 30 to move the fin restraining element 38 from a locked position to an unlocked position relative to the set of fins 24. While the first spring-loaded stage 32 can be configured in a variety of ways, in one arrangement the first spring-loaded stage 32 includes a drive element 33, a ball lock/release mechanism 35, and a lock/release spring 37.

The drive element 33, in one arrangement, is configured as a shaft having a first end 50 coupled to the fin restraining element 38 and a second end 52 coupled to the ball lock/release mechanism 35. The drive element 33 is moveably supported by the support structure 22 of the deployment system 20 such that the support structure 22 limits movement of the first spring-loaded stage 32 to translational movement along a longitudinal axis 36 of the deployment assembly 26. Such translational movement of the drive element 33 provides the output force to the fin restraining element 38.

The lock/release spring 37 is configured to provide the first spring-loaded output force to the fin restraining element 38 to move the fin restraining element 38 from a locked position to an unlocked position. For example, as illustrated in FIG. 2, the lock/release spring 37 is disposed between the fin restraining element 38 and a base portion 54 of the support structure 22. While the lock/release spring 37 can be configured in a variety of ways, in one arrangement, the lock/release spring 37 is a coil spring that surrounds a portion of the drive element 33. As illustrated, the lock/release spring 37 is compressed between the fin restraining element 38 and the base portion 54 in an initial, locked state and allowed to expand between the fin restraining element 38 and the base portion 54 in a second, expanded state. It should be understood that other types of springs, such as a torsion spring or an extension spring can be used in place of the lock/release spring 37. While the lock/release spring 37 can be configured to generate a variety of spring forces, in one arrangement, the lock/release spring 37 has a spring constant k1 that is configured to generate a force of about 17 pounds force.

Figure 3:
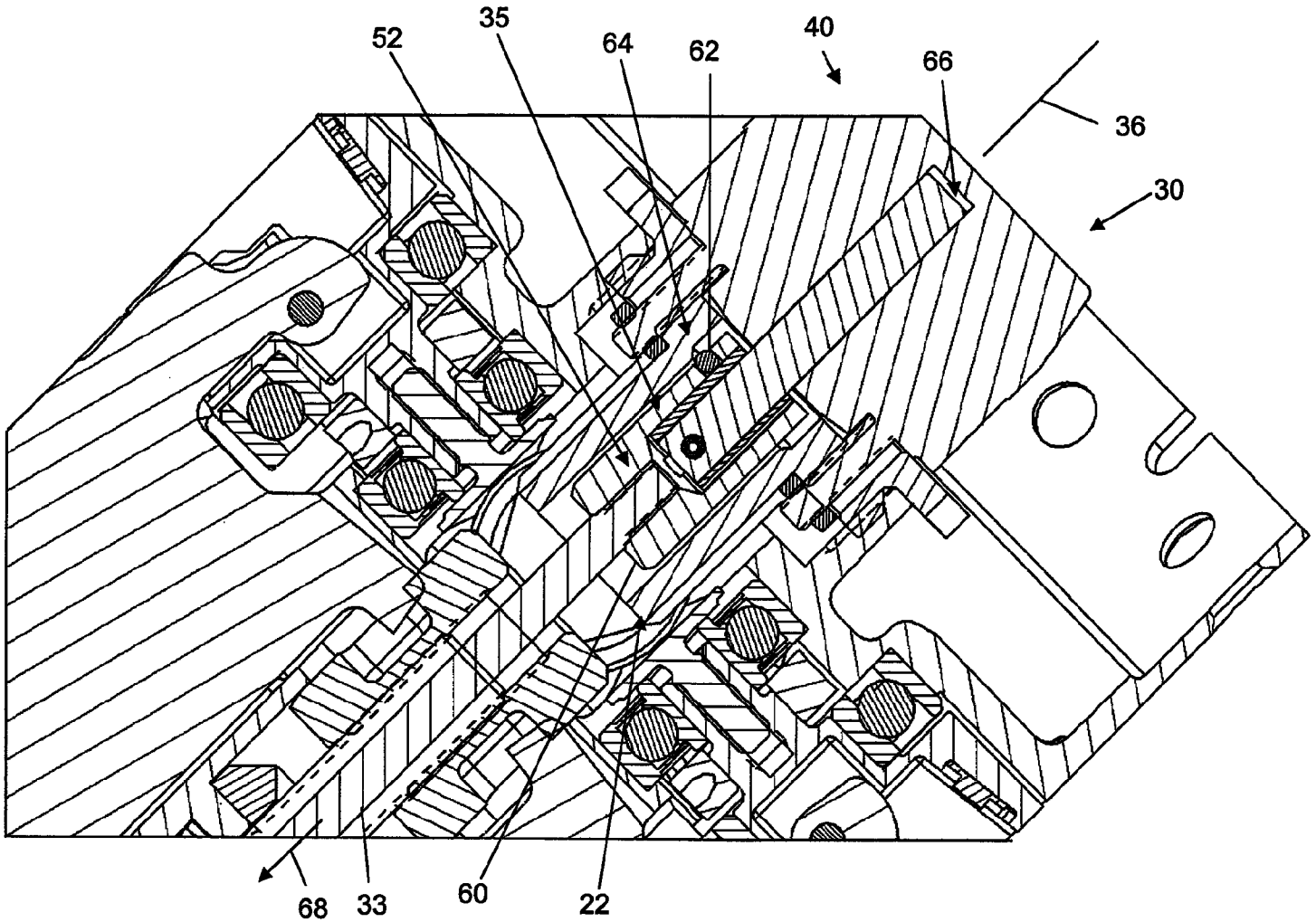
FIG. 3 illustrates a ball lock/release mechanism of the deployment assembly of FIG. 2, according to one embodiment.

The ball lock/release mechanism 35 is configured to initially reside in a locked state in which the lock/release spring 37 is compressed along a common axis 36 between the base portion 54 and the fin restraining element 38. The ball lock/release mechanism 35 is also configured to transition from the locked state to an unlocked state in which the lock/release spring 37 decompresses along the common axis 36 to move the drive element 33 linearly relative to the base portion 54. As illustrated in FIG. 3, the ball lock/release mechanism 35 interacts with the actuator 35 to transition from the locked state to the unlocked state.

FIG. 3 illustrates an arrangement of the ball lock/release mechanism 35 interfacing with the actuator 30. The ball lock/release mechanism 35 includes a housing portion 60 carried by the drive element 33 and a set of balls 62 disposed within a channel 64 defined by the housing portion 60. In a locked state, as illustrated, the actuator 30 is configured to maintain the set of balls 62 within the channel 64 between a rotor 66 of the actuator 30 and the support structure 22 of the deployment system 20. In such a locked state, returning to FIG. 2, interaction between the rotor 66 of the actuator 30 and the ball lock/release mechanism 35 maintains the lock/release spring 37 in a compressed state which, in turn, maintains the fin restraining element 38 in positional cooperation with the fins 24 to retain the fins 24 in a non-deployed state.

Returning to FIG. 3, to position the ball lock/release mechanism 35 toward an unlocked state, the actuator 30 is configured to provide an actuator force to the lock/release mechanism 35 to release the set of balls 62 from within the channel 64. For example, in response to a control signal 40, the actuator 30 is configured to rotate the rotor 66 about an axis of rotation, such as longitudinal axis 36, over a limited arc length, such as an arc length of about 90°. With such rotation, the rotor 66 releases the set of balls 62 from the channel 64 and the support structure 22. In response to release of the set of balls 62, and taken in conjunction with FIG. 2, the lock/release spring 37 is configured to expand from the compressed state and, in response, the housing portion 60 and the drive element 33 are allowed to translate along a direction 68 substantially parallel to the common axis 36. With such translation, the drive element 33 linearly displace the fin restraining element 38 along the common axis 36 from positional cooperation with the fins 24 to allow release the fins 24 from the non-deployed state.

With reference to FIG. 2, in the arrangement illustrated, the second spring-loaded stage 34 of the deployment assembly 26 is configured to provide a second spring-loaded output force in response to the first spring-loaded output force from the first spring-loaded stage 32. As will be described in detail below, the second spring-loaded stage 34 applies the second spring-loaded output force to the set of fins 24 to move the set of fins 24 from an initial non-deployed configuration, as shown in FIG. 2, to a subsequent deployed configuration relative to the support structure 22. While the second spring-loaded stage 34 can be configured in a variety of ways, in one arrangement the second spring-loaded stage 34 includes a deployment element 70, a deployment spring 72, and a deployment shuttle 74.

In one arrangement, the deployment element 70 is configured as a shaft having a first end 76 disposed in operative communication with the deployment spring 72 and a second end 78 coupled to the deployment shuttle 74. The deployment element 70 is moveably supported by the support structure 22 of the deployment system 20 such that the support structure 22 limits movement of the deployment element 70 to translational movement along a longitudinal axis 36 of the deployment assembly 26. As will be described below, such translational movement of the deployment element 70 provides the second spring-loaded output force to the set of fins 24. As illustrated, the deployment element, as well as the deployment shuttle 74, surrounds the drive element 33 of the first spring-loaded stage 32. In such an arrangement, the deployment element 70 and deployment shuttle 74 can translate along the longitudinal axis 36 of the deployment system 20 independent from the drive element 33. To minimize friction between the drive element 33 and both the deployment element 70 and deployment shuttle 74, the deployment assembly 26 includes a lubrication layer, such as an oil layer, disposed between the deployment element 70 and the drive element 33.

The deployment spring 72 is configured to provide the second spring-loaded output force to the set of fins 24 to move the set of fins 24 from the initial non-deployed configuration to the subsequent deployed configuration. In one arrangement, the deployment spring 72 is disposed between the first end 76 of the deployment element 70 and a load bearing portion 80 of the support structure 22. As illustrated, the deployment spring 72 is compressed between the first end 76 of the deployment element 70 and the load bearing portion 80 in an initial, locked state and is allowed to expand between the first end 76 of the deployment element 70 and the load bearing portion 80 in a second, expanded state. While the deployment spring 72 can be configured in a variety of ways, in one arrangement, the deployment spring 72 is a series of disc springs that surrounds a portion of the deployment element 70. It should be understood that other types of springs, such as a torsion spring or an extension spring can be used in place of the deployment spring 72. While the deployment spring 72 can be configured to generate a variety of spring forces, in one arrangement, the deployment spring 72 has a spring constant k2 that is configured to generate a force of about 200 pounds force. In such an arrangement, the spring constant k2 of the deployment spring 72 exceeds the spring constant k1 of the lock/release spring 37 by at least a factor of ten to provide a multi-stage force magnification effect on the set of fins 24 during deployment.

The deployment shuttle 74, as carried by the deployment element 70, is disposed in operative communication with the set of fins 24. For example, the deployment shuttle 74 includes a base portion 79 disposed in operational communication with actuator levers 82 of the set of fins 24 and a head portion 84 configured to interact with a stop portion 86 of the deployment system 20 during operation. The deployment shuttle 74 is configured to initially reside in a first state, as shown in FIG. 2, in which the deployment spring 72 is compressed along the common axis 36 between the load bearing portion 80 and the deployment element 70 (i.e., a head portion 88 of the deployment element 70). The deployment shuttle 74 is further configured to transition from the first state to a second state (not shown) in which the deployment spring 72 decompresses or expands along the common axis 36 to move the deployment element 70 linearly relative to the load bearing portion 80 of the support structure 22.

Figure 4:
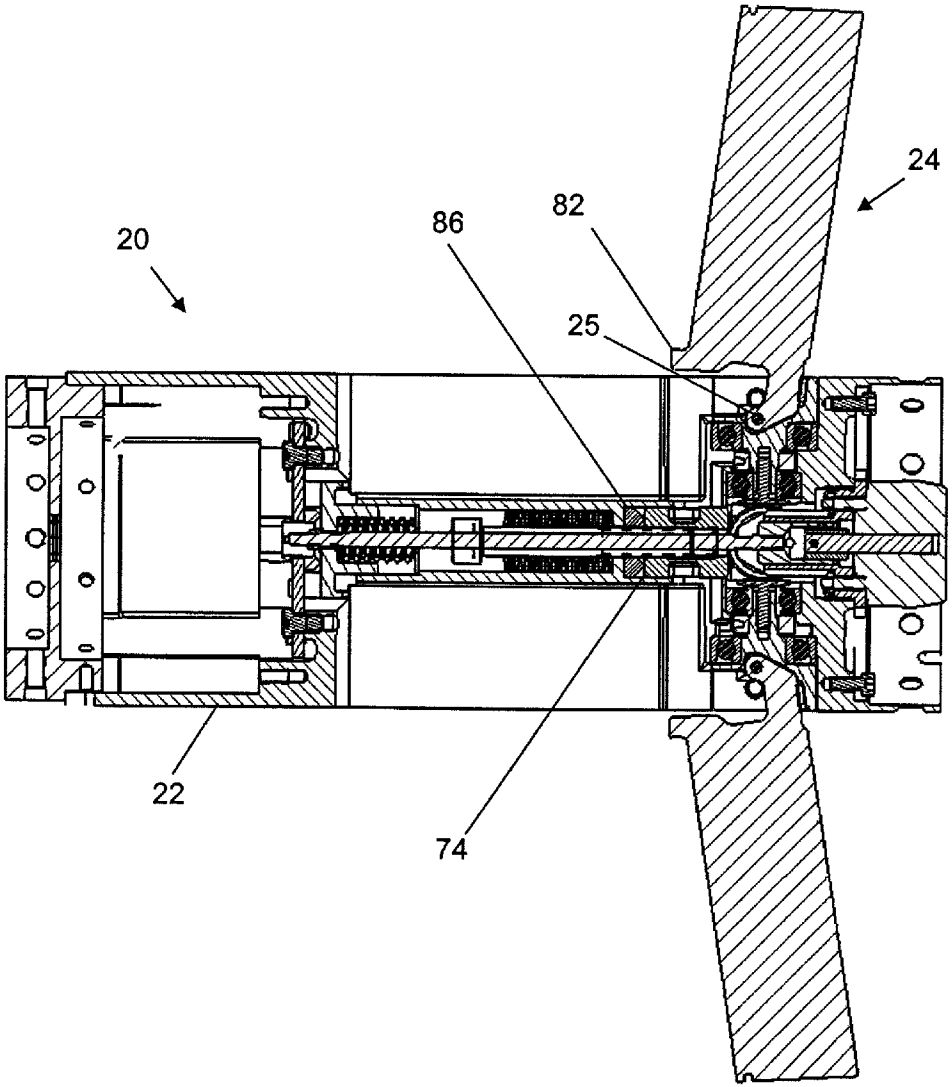
FIG. 4 illustrates a sectional view of the deployment assembly of FIG. 1 having fins disposed in a deployed state.

For example, taken in conjunction with the first spring-loaded stage 32, when the drive element 33 linearly displace the fin restraining element 38 along the common axis 36 from positional cooperation with the fins 24, the fins 24 are released from the support structure 22 and are free to rotate about pivot locations or common axis pivots 25. Furthermore, in response to the ball lock/release mechanism 35 transition from the locked state to the unlocked state and the fin restraining element 38 translating along the common axis 26, the deployment spring 72 positions from the compressed state to a decompressed or expanded state. Such positioning of the deployment spring 72 causes the deployment element 70 and the deployment shuttle 74 to transition from a first state as shown to a second state. With such transition, movement of the deployment shuttle 74 along the common axis 36 causes the base portion 79 of the deployment shuttle 74 to generate a force on the actuator levers 82 of the set of fins 24 until the head portion 84 contacts the stop portion 86. The relatively large force generated by the deployment spring 72, as well as interaction between the base portion 79 and the actuator levers 82, pivots each fin 24 about the corresponding pivot mechanism 25 to allow the fins 24 to engage a deployed position relative to the guidable projectile frame 22, as illustrated in FIG. 4.

Figure 5:
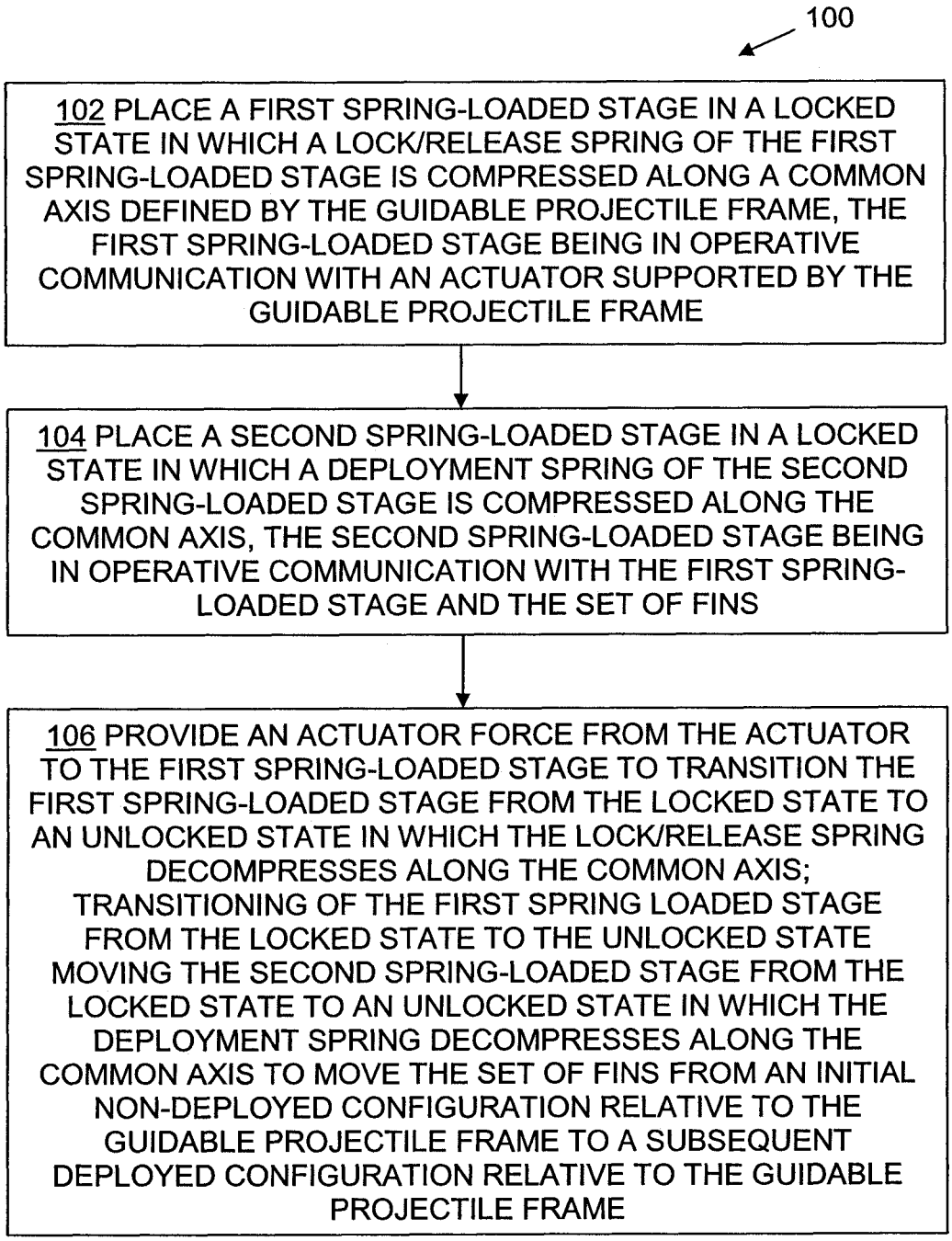
FIG. 5 is a flowchart that illustrates a method of deploying a set of fins relative to a guidable projectile frame.

FIG. 5 is a flowchart 100 that illustrates a method of deploying a set of fins 24 relative to a guidable projectile frame 22.

In step 102, a user places a first spring-loaded stage 32 in a locked state in which a lock/release spring 37 of the first spring-loaded stage 32 is compressed along a common axis 36 defined by the guidable projectile frame 22, the first spring-loaded stage 32 being in operative communication with an actuator 30 supported by the guidable projectile frame 22. For example, with reference to FIGS. 2 and 3, the user first compresses the lock/release spring 37 between the base portion 54 of the support structure 22 and the fin restraining element 38 by translating the restraining element 38 along direction 90 until the restraining element 38 is disposed in cooperative engagement with the set of fins 24. For example, with such translation, a set of fingers 92 of the fin restraining element 38 engages and is held by a set of openings or grooves 94 defined by the set of fins. Such engagement holds the set of fins 24 in a non-deployed state relative to the guidable projectile frame 22.

Returning to FIG. 5, in step 104, a user places a second spring-loaded stage 34 in a locked state in which a deployment spring 72 of the second spring-loaded stage 34 is compressed along the common axis 36, the second spring-loaded stage 34 being in operative communication with the first spring-loaded stage 32 and the set of fins 24. For example, with reference to FIGS. 2 and 3, as the user compresses the lock/release spring 37 of the first spring-loaded stage 32, the fins 24 rotate toward the common axis of the frame 22. Such rotation of the fins 24 causes the actuator levers 82 of the set of fins 24 to generate a force along direction 90 on the base portion 79 of the deployment shuttle 74 which, in turn compresses the deployment spring 72 between the first end 76 of the deployment element 70 and the load bearing portion 80 of the support structure 22. With the deployment element 70 compressed, the user engages the ball lock/release mechanism 35 with the actuator 30 to lock the first spring-loaded stage 32 and the second spring-loaded stage 34 to the guidable projectile frame 22.

Returning to FIG. 5, in step 106, the user provides an actuator force from the actuator 30 to the first spring-loaded stage 32 to transition the first spring-loaded stage 32 from the locked state to an unlocked state in which the lock/release spring 37 decompresses along the common axis, transitioning of the first spring-loaded stage 32 from the locked state to the unlocked state moving the second spring-loaded stage 34 from the locked state to an unlocked state in which the deployment spring 72 decompresses along the common axis 36 to move the set of fins 24 from an initial non-deployed configuration relative to the guidable projectile frame 22 to a subsequent deployed configuration relative to the guidable projectile frame 22.

For example, with reference to FIGS. 2 and 3, in response to receipt of a control signal 40, the actuator 30 provides a relatively small actuator force 42 or torque to the rotor 66 to rotate the rotor about an axis of rotation to releases the set of balls 62 from the channel 64 and the support structure 22. In response to release of the set of balls 62, the lock/release spring 37 expands along the common axis 36 from the compressed state and disengages the fin restraining element 38 from the set of fins 24. With expansion of the lock/release spring 37, the deployment spring 72 expands between the first end 76 of the deployment element 70 and the load bearing portion 80, thereby causing the deployment shuttle 74 to transition from the first state, as shown in FIG. 2, to a second state. With such transition, movement of the deployment shuttle 74 along the common axis 36 causes the base portion 79 of the deployment shuttle 74 to generate a force on the actuator levers 82 of the set of fins 24 until the head portion 84 contacts the stop portion 86. The relatively large force generated by the deployment spring 72, as well as interaction between the base portion 79 and the actuator levers 82, pivots each fin 24 about the corresponding pivot mechanism 25 to allow the fins 24 to engage a deployed position relative to the guidable projectile frame 22, as illustrated in FIG. 4.

With respect to the deployment system 20, the use of the actuator 30 in conjunction with the first spring-loaded stage 32 and the second spring loaded stage 34 provides a two-staged force magnification for the deployment system 20 such that a relatively small input force or torque, as provided by the actuator 30, generates a relatively large output force, as provided by the second spring loaded stage 34, to rotate the fins 24 from a non-deployed state to a deployed state. For example, with this force magnification, the actuator 30 can be electrically and physically sized to generate a torque that overcomes the spring force, such as a force of 17 pounds force of the lock/release spring 37. Release of the lock/release spring 37 causes the deployment spring to expand from the compressed state to generate relatively large spring force, such as a force that is at lease ten times greater than the spring force of the lock/release spring 37, to cause the fins 24 to engage a deployed position.

While various embodiments of the invention have been particularly shown and described, it will be understood by those skilled in the art that various changes in form and details may be made therein without departing from the spirit and scope of the invention as defined by the appended claims.

As indicated above, the actuator 30 is constructed and arranged to receive an electronic input, such as a control signal 40 and to provide an actuator force 42 to the first spring-loaded stage 32 in response to the electronic input 40. The actuator 30 is configured to receive the control signal 40 in a variety of ways. In one arrangement, the actuator 30 is configured to receive the command signal 40 as a radio signal from a command center, such as remote ground base.

What is claimed is:

1. A guidable projectile, comprising:

a guidable projectile frame having a support structure;

a set of fins, each fin being pivotally attached to the guidable projectile frame; and a deployment assembly to deploy a set of fins relative to the guidable projectile frame, the deployment assembly including:

an actuator supported by the support structure, the actuator being constructed and arranged to provide an actuator force;

a first spring-loaded stage supported by the support structure and in operative communication with the actuator, the first spring-loaded stage being constructed and arranged to provide a first spring-loaded output force to a fin restraining element in response to the actuator force from the actuator to move the fin restraining element from a locked position to an unlocked position relative to the set of fins; and a second spring-loaded stage supported by the support structure and in operative communication with the first spring-loaded stage, the second spring-loaded stage being constructed and arranged to provide a second spring-loaded output force in response to the first spring-loaded output force from the first spring-loaded stage, the second spring-loaded output force being applied to the set of fins to move the set of fins from an initial non-deployed configuration relative to the support structure to a subsequent deployed configuration relative to the support structure.

2. A guidable projectile as in claim 1, wherein the first spring-loaded stage includes:

a drive element in operative communication with the fin restraining element and with the second spring-loaded stage, a lock/release spring in contact with a base portion and with the drive element, and a ball lock/release mechanism coupled to the drive element, the ball lock/release mechanism being constructed and arranged to (i) initially reside in a locked state in which the lock/release spring is compressed along a common axis between the base portion and the fin restraining element, and (ii) transition from the locked state to an unlocked state in which the lock/release spring decompresses along the common axis to move the drive element linearly relative to the base portion.

3. A guidable projectile as in claim 2, wherein the actuator includes a rotary solenoid having a stator supported by the guidable projectile frame, and a rotor in operative communication with the ball lock/release mechanism of the first spring-loaded stage;

wherein the rotary solenoid is constructed and arranged to rotate the rotor about the common axis when the actuator provides the actuator force to transition the ball lock/release mechanism from the locked state to the unlocked state.

4. A guidable projectile as in claim 3, wherein the second spring-loaded stage includes:

a deployment element, a deployment spring in contact with a load bearing portion and the deployment element, and a deployment shuttle carried by the deployment element and in operative communication with the set of fins, the deployment shuttle being constructed and arranged to (i) initially reside in a first state in which the deployment spring is compressed along the common axis between the load bearing portion and the deployment element, and (ii) transition from the first state to a second state in which the deployment spring decompresses along the common axis to move the deployment element linearly relative to the load bearing portion.

5. A guidable projectile as in claim 4, wherein the drive element of the first spring-loaded stage is constructed and arranged to linearly displace the fin restraining element along the common axis when the first spring-loaded stage provides the first spring-loaded output force in response to the actuator force from the actuator, displacement of the fin restraining element along the common axis transitioning the deployment shuttle from the first state to the second state.

6. A guidable projectile as in claim 5, wherein each fin is pivotally attached to the guidable projectile frame; and wherein decompression of the deployment spring and movement of the deployment shuttle along the common axis pivots each fin from a non-deployed position to a deployed position relative to the guidable projectile frame.

7. A guidable projectile as in claim 5, wherein the lock/release spring of the first spring-loaded stage has a first spring constant (k1);

wherein the deployment spring of the second spring-loaded stage has a second spring constant (k2); and wherein second spring constant (k2) exceeds the first spring constant (k1) by at least a factor of ten (10) to provide a multi-stage force magnification effect on the set of fins during deployment.

8. A guidable projectile as in claim 5, wherein the set of fins includes at least two fins; and wherein, during deployment, movement of the deployment shuttle along the common axis pivots each fin in a respective radially outward direction relative to the common axis.

9. A guidable projectile as in claim 5, wherein the guidable projectile frame defines a hollow core to contain and protect the lock/release spring of the first spring-loaded stage and the deployment spring of the second spring-loaded stage.

10. A deployment assembly to deploy a set of deployable members relative to a support structure, comprising:

an actuator supported by the support structure, the actuator being constructed and arranged to provide an actuator force;

a first spring-loaded stage supported by the support structure and in operative communication with the actuator, the first spring-loaded stage being constructed and arranged to provide a first spring-loaded output force to a deployable member restraining element in response to the actuator force from the actuator to move the deployable member restraining element from a locked position to an unlocked position relative to the set of deployable members; and a second spring-loaded stage supported by the support structure and in operative communication with the first spring-loaded stage, the second spring-loaded stage being constructed and arranged to provide a second spring-loaded output force in response to the first spring-loaded output force from the first spring-loaded stage, the second spring-loaded output force being applied to the set of deployable members to move the set of deployable members from an initial non-deployed configuration relative to the support structure to a subsequent deployed configuration relative to the support structure.

11. A deployment assembly as in claim 10, wherein the first spring-loaded stage includes:

a drive element in operative communication with the deployable member restraining element and with the second spring-loaded stage, a lock/release spring in contact with a base portion and with the drive element, and a ball lock/release mechanism coupled to the drive element, the ball lock/release mechanism being constructed and arranged to (i) initially reside in a locked state in which the lock/release spring is compressed along a common axis between the base portion and the fin restraining element, and (ii) transition from the locked state to an unlocked state in which the lock/release spring decompresses along the common axis to move the drive element linearly relative to the base portion.

12. A deployment assembly as in claim 11, wherein the actuator includes a rotary solenoid having a stator supported by the support structure, and a rotor in operative communication with the ball lock/release mechanism of the first spring-loaded stage;

wherein the rotary solenoid is constructed and arranged to rotate the rotor about the common axis when the actuator provides the actuator force to transition the ball lock/release mechanism from the locked state to the unlocked state.

13. A deployment assembly as in claim 12, wherein the second spring-loaded stage includes:

a deployment element, a deployment spring in contact with a load bearing portion and the deployment element, and a deployment shuttle carried by the deployment element and in operative communication with the set of deployable members, the deployment shuttle being constructed and arranged to (i) initially reside in a first state in which the deployment spring is compressed along the common axis between the load bearing portion and the deployment element, and (ii) transition from the first state to a second state in which the deployment spring decompresses along the common axis to move the deployment element linearly relative to the load bearing portion.

14. A deployment assembly as in claim 13, wherein the drive element of the first spring-loaded stage is constructed and arranged to linearly displace the deployable member restraining element along the common axis when the first spring-loaded stage provides the first spring-loaded output force in response to the actuator force from the actuator, displacement of the deployable member restraining element along the common axis transitioning the deployment shuttle from the first state to the second state.

15. A deployment assembly as in claim 14, wherein the support structure is a guidable projectile frame;

wherein the set of deployable members includes a set of fins, each fin being pivotally attached to the guidable projectile frame; and wherein decompression of the deployment spring and movement of the deployment shuttle along the common axis pivots each fin from a non-deployed position to a deployed position relative to the guidable projectile frame.

16. A deployment assembly as in claim 14, wherein the lock/release spring of the first spring-loaded stage has a first spring constant (k1);

wherein the deployment spring of the second spring-loaded stage has a second spring constant (k2); and wherein second spring constant (k2) exceeds the first spring constant (k1) by at least a factor of ten (10) to provide a multi-stage force magnification effect on the set of deployable members during deployment.

17. A deployment assembly as in claim 14, wherein the set of deployable members includes at least two fins; and wherein, during deployment, movement of the deployment shuttle along the common axis pivots each fin in a respective radially outward direction relative to the common axis.

18. A deployment assembly as in claim 14, wherein the support structure defines a hollow core to contain and protect the lock/release spring of the first spring-loaded stage and the deployment spring of the second spring-loaded stage.

19. A method of deploying a set of fins relative to a guidable projectile frame, the method comprising:

placing a first spring-loaded stage in a locked state in which a lock/release spring of the first spring-loaded stage is compressed along a common axis defined by the guidable projectile frame, the first spring-loaded stage being in operative communication with an actuator supported by the guidable projectile frame;

placing a second spring-loaded stage in a locked state in which a deployment spring of the second spring-loaded stage is compressed along the common axis, the second spring-loaded stage being in operative communication with the first spring-loaded stage and the set of fins; and providing an actuator force from the actuator to the first spring-loaded stage to transition the first spring-loaded stage including a deployable member restraining element from the locked state to an unlocked state relative to the set of fins in which the lock/release spring decompresses along the common axis, transitioning of the first spring loaded stage from the locked state to the unlocked state moving the second spring-loaded stage from the locked state to an unlocked state in which the deployment spring decompresses along the common axis to move the set of fins from an initial non-deployed configuration relative to the guidable projectile frame to a subsequent deployed configuration relative to the guidable projectile frame.

20. A method as in claim 19, wherein the lock/release spring of the first spring-loaded stage has a first spring constant (k1);

wherein the deployment spring of the second spring-loaded stage has a second spring constant (k2); and wherein second spring constant (k2) exceeds the first spring constant (k1) by at least a factor of ten (10) to provide a multi-stage force magnification effect on the set of fins during deployment.

21. The guidable projectile as in claim 1, wherein the fin restraining element includes a set of fingers, each finger of the set of fingers configured to engage a corresponding groove in each fin of the set of fins.

22. The deployment assembly as in claim 10, wherein the deployable member restraining element includes a set of fingers, each finger of the set of fingers configured to engage a groove in each member of the set of deployable members.

23. The method as in claim 19, wherein transitioning of the first spring-loaded stage from the locked state to the unlocked state, further includes:

disengaging a finger of a set of fingers of the first spring-loaded stage from a corresponding groove in each fin of the set of fins.

* * * * *